US008741391B2

(12) United States Patent
Kawai et al.

(10) Patent No.: US 8,741,391 B2
(45) Date of Patent: Jun. 3, 2014

(54) DIP-COATING PROCESS AND METHOD FOR MAKING ELECTROPHOTOGRAPHIC PHOTOSENSITIVE MEMBER

(75) Inventors: Yasuhiro Kawai, Susono (JP); Kenichi Kaku, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 13/124,000

(22) PCT Filed: Oct. 9, 2009

(86) PCT No.: PCT/JP2009/067949

§ 371 (c)(1),
(2), (4) Date: Apr. 13, 2011

(87) PCT Pub. No.: WO2010/044475

PCT Pub. Date: Apr. 22, 2010

(65) Prior Publication Data

US 2011/0200743 A1 Aug. 18, 2011

(30) Foreign Application Priority Data

Oct. 15, 2008 (JP) ..... 2008-266532

(51) Int. Cl.

| | |
|---|---|
| ***B05D 1/18*** | (2006.01) |
| ***B05D 3/04*** | (2006.01) |
| ***B05C 3/02*** | (2006.01) |
| ***B05C 15/00*** | (2006.01) |
| ***G03G 5/00*** | (2006.01) |
| ***G03G 5/05*** | (2006.01) |

(52) U.S. Cl.

CPC ..... *B05D 1/18* (2013.01); *B05D 3/0406* (2013.01); *B05D 3/0486* (2013.01); *B05C 3/02* (2013.01); *B05C 15/00* (2013.01); *G03G 5/00* (2013.01); *G03G 5/0525* (2013.01)

USPC ..... 427/430.1; 427/327; 427/377; 427/378

(58) Field of Classification Search

USPC ..... 427/430.1, 435

See application file for complete search history.

(56) References Cited

U.S. PATENT DOCUMENTS

2011/0200743 A1* 8/2011 Kawai et al. ..... 427/162

FOREIGN PATENT DOCUMENTS

CN 1946901 A 4/2007
CN 101062872 A 10/2007

(Continued)

OTHER PUBLICATIONS

Machine Translation ofJP 2002278103 A.*

(Continued)

*Primary Examiner* — David Turocy

(74) *Attorney, Agent, or Firm* — Canon U.S.A., Inc. IP Division

(57) ABSTRACT

A dip-coating process includes immersing a member to be coated in a coating solution in a coating vessel and lifting the member to be coated while covering a side surface of the member to be coated with a telescopic sliding hood to form a coating film on a surface of the member to be coated. The telescopic sliding hood includes a plurality of tubular members connected so that their diameters successively decrease upward in a dip-coating direction, and can cover the side surface of the member to be coated by extending in association with the movement of the member to be coated during the lift of the member to be coated. While the member to be coated is being lifted, a downward airflow in the dip-coating direction is generated in a gap between an inner surface of the telescopic sliding hood and the member to be coated to discharge solvent vapor to outside the telescopic sliding hood.

3 Claims, 6 Drawing Sheets

(56) References Cited

FOREIGN PATENT DOCUMENTS

| | | | | |
|---|---|---|---|---|
| EP | 2161622 | A2 | | 3/2010 |
| JP | 63-007873 | A | | 1/1988 |
| JP | 63007873 | A | * | 1/1988 |
| JP | 07-104488 | A | | 4/1995 |
| JP | 2001-194814 | A | | 7/2001 |
| JP | 2002-278103 | A | | 9/2002 |
| JP | 2002278103 | A | * | 9/2002 |
| JP | 2002-351103 | A | | 12/2002 |
| JP | 2003-149836 | A | | 5/2003 |
| JP | 2007-086176 | A | | 4/2007 |
| JP | 2007086176 | A | * | 4/2007 |
| JP | 2007-271705 | A | | 10/2007 |

OTHER PUBLICATIONS

Machine Translation of JP 2007086176 A.*

* cited by examiner

DIP-COATING PROCESS AND METHOD FOR MAKING ELECTROPHOTOGRAPHIC PHOTOSENSITIVE MEMBER

TECHNICAL FIELD

The present invention relates to a dip-coating process and a method for making an electrophotographic photosensitive member incorporating the dip-coating process.

BACKGROUND ART

In general, an electrophotographic photosensitive member, in particular, an electrophotographic photosensitive member using an organic material (organic photosensitive member), includes a supporting member and at least one layer formed by coating (coating film) on the supporting member.

A typical coating process used in manufacturing the electrophotographic photosensitive member includes immersing a member to be coated (supporting member or a supporting member with at least one layer formed thereon) in a coating solution in a coating vessel and lifting the member to be coated so that the coating solution adheres on the surface of the member to be coated and thereby forms a coating film. For immersion and lift, a holder member for holding the member to be coated and a lift for moving the member to be coated held by the holder member up and down are used.

The thickness of the coating film formed by a dip-coating process is basically determined by the viscosity of the coating solution, the volatility of the solvent in the coating solution (coating film), the rate of lifting the member to be coated, etc. The coating film formed on the surface of the member to be coated is initially in a wet state and sags downward in the direction of gravitational force until a particular amount or more of the solvent in the coating film evaporates and the coating film becomes substantially dry. As a result, the thickness of the coating film at the same position undergoes changes immediately after lift.

When the coating film is affected by ambient wind during evaporation of the solvent, the degree at which evaporation proceeds varies locally, and the degree of sagging of the coating film becomes nonuniform, resulting in uneven coating film thickness. This is because when the solvent evaporates from the coating film under ambient wind into solvent vapor, a bias is generated in the concentration of the solvent vapor around the coating film due to the local differences in the degree at which the evaporation proceeds.

Another example of the phenomenon causing the unevenness in the coating film thickness other than the sagging of the coating film in the direction of gravitational force is a phenomenon in which the coating solution adhering on the surface of the member to be coated moves in a particular direction irrelevant to the direction of gravitational force in a biased manner due to actions such as surface tension, intermolecular force in the coating solution, etc.

When the thickness distribution is locally nonuniform due to the various phenomena described above, i.e., when there is a thickness variation, image formation using an electrophotographic photosensitive member is adversely affected.

A popular and effective approach for preventing the thickness variation in the coating film is to lift the member to be coated while covering the side surface of the member to be coated with a hood. When the hood is used during evaporation of the solvent from the coating film in a wet state, the local difference in the degree at which the evaporation proceeds induced by ambient wind can be suppressed.

Another proposed approach is to use a hood formed by connecting a plurality of tubular members such that the hood is extendable and retractable by sliding the respective tubular members (also known as telescopic sliding hood).

Japanese Patent Laid-Open No. 07-104488 teaches a method in which a member to be coated is immersed in a coating solution in a coating vessel and lifted while covering the side surface by extending and retracting the telescopic sliding hood in association with the lift operation.

Japanese Patent Laid-Open No. 63-007873 teaches a coating method in which an telescopic sliding hood is used and the vapor of the solvent evaporating from the coating solution is discharged outside the telescopic sliding hood so that the solvent vapor concentration is low around the coating film on the member to be coated. According to this method, since the solvent vapor concentration around the coating film is low, the time required for evaporation of the solvent can be shortened, and various phenomena occurring during solvent evaporation can be suppressed.

Electrophotographic apparatuses are now being required to achieve higher performance, in particular, higher sensitivity and higher image uniformity. To meet such a requirement, further thickness reduction of the coating film is desirable. When the thickness is reduced, the effect of the thickness variation on the quality of the electrophotographic apparatus becomes greater.

Under such circumstances, the technique of lift the member to be coated while covering the side surface of the member to be coated with the telescopic sliding hood or the technique of evacuating the solvent vapor inside the telescopic sliding hood to outside thereof is no longer sufficient. In other words, a solvent evaporation environment more stable than that in the related art is desired.

Patent Citation 1

Japanese Patent Laid-Open No. 07-104488

Patent Citation 2

Japanese Patent Laid-Open No. 63-007873

DISCLOSURE OF INVENTION

Technical Problem

It is desirable to provide a dip-coating process in which the evaporation environment for the solvent is stable and a method for making an electrophotographic photosensitive member incorporating such a dip-coating process.

A first aspect of the present invention provides a dip-coating process that includes immersing a member to be coated in a coating solution in a coating vessel; and lifting the member to be coated while covering a side surface of the member to be coated with a telescopic sliding hood to form a coating film on a surface of the member to be coated. The telescopic sliding hood includes a plurality of tubular members connected so that their diameters successively decrease upward in a dip-coating direction, and can cover the side surface of the member to be coated by extending in association with the movement of the member to be coated during the lift of the member to be coated. While the member to be coated is being lifted, a downward airflow in the dip-coating direction is generated in a gap between an inner surface of the telescopic sliding hood and the member to be coated to discharge solvent vapor to outside the telescopic sliding hood.

Another aspect of the present invention provides a method for making an electrophotographic photosensitive member. The method includes a step of forming a coating film on a surface of a member to be coated by dip-coating, and this dip-coating includes the dip-coating process described above.

The present invention can provide a dip-coating process in which the evaporation environment for the solvent is stable and a method for making an electrophotographic photosensitive member incorporating such a dip-coating process.

DESCRIPTION OF EMBODIMENTS

The present invention will now be described in detail.

The inventors of the present invention conducted extensive studies to address challenges described above and identified the cause of disturbance in the environment of solvent evaporation that has occurred in the existing coating process. The inventors have also found the ways to eliminate the cause and made the present invention, as described below.

In order to discharge the solvent vapor to outside the telescopic sliding hood, the solvent vapor must be allowed to pass a gap between the inner surface of the telescopic sliding hood and the member to be coated. The movement of the solvent vapor forms an airflow. The concentration of the solvent vapor around the coating film on the member to be coated can be lowered by discharging the solvent vapor to outside the telescopic sliding hood.

The studies conducted by the inventors have revealed that the airflow near the surface of the coating film on the member to be coated is slightly turbulent. It has also been found that the turbulence in the airflow causes a similar phenomenon to that caused by the ambient wind described above (phenomenon in which evaporation proceeds in different degrees between different parts).

One of the causes of the turbulence in the airflow is the presence of steps at the joints (connecting portions between tubular members) of the telescopic sliding hood. In order to extend and retract the telescopic sliding hood, it is essential that the plurality of tubular members constituting the telescopic sliding hood have different diameters. That is, a difference in diameter that enables sliding must be secured between any one tubular member and its adjacent tubular members among the plurality of the tubular members.

Figure 5A:
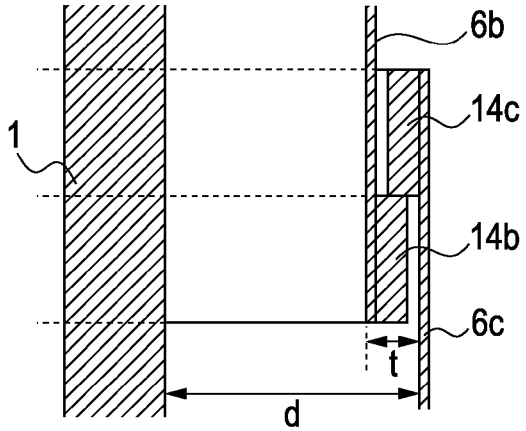
FIGS. 5A and 5B are cross-sectional views showing a gap between a member to be coated and a connecting portion between one tubular member and an adjacent tubular member of a telescopic sliding hood.

As shown in FIG. 5A, in the case where the tubular member is connected to the adjacent connecting member by hooking, the overlap margin for hooking must additionally be secured in a connecting portion between the tubular members.

In view of the above, presence of steps at the connecting portions between tubular members is unavoidable.

In the case shown in FIG. 5A, the height of a step is substantially equal to a half the difference between the inner diameter of a smaller tubular member and the inner diameter of a larger tubular member at the connecting portion between the adjacent tubular members.

Figure 5B:
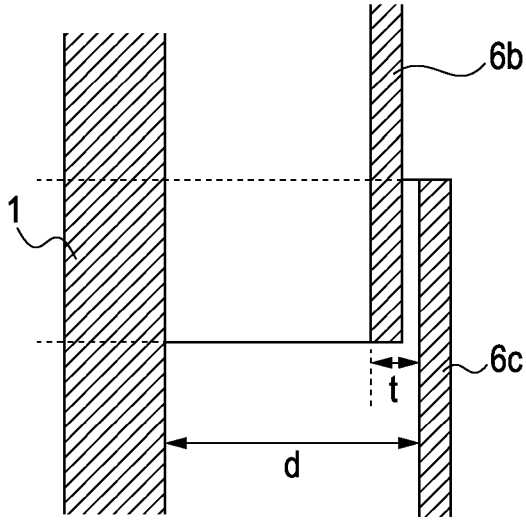

In the case shown in FIG. 5B, the height of a step is substantially equal to the sum of the wall thickness of a smaller tubular member and the length of the gap between the tubular members at the connecting portion. In the case where the tubular members are connected to each other by hooking as described above, the height of the step is the above-described sum plus the overlap margin.

When the direction in which the solvent vapor travels (direction of the airflow) through the gap between the inner surface of the telescopic sliding hood and the member to be coated is the direction that stretches from larger tubular members to smaller tubular members among the plurality of the tubular members constituting the telescopic sliding hood, the step functions as a protrusion.

Thus, when the airflow passes near the step, part of the airflow collides with the protruding step, and the airflow becomes turbulent as a result. Then the turbulent airflow hits part of the surface of the coating film in a wet state and accelerates or decelerates evaporation of the solvent from that part of the coating film, thereby creating thickness variation.

Accordingly, in the present invention, a telescopic sliding hood constituted by a plurality of tubular members connected so that the diameters of the tubular members successively decrease upward in the dip-coating direction is used. When the member to be coated is being lifted, an airflow that travels downward in the dip-coating direction (hereinafter also referred to as "downward airflow in the dip-coating direction") is generated in the gap between the inner surface of the telescopic sliding hood and the member to be coated to discharge the solvent vapor to outside the telescopic sliding hood.

According to the present invention, the steps of the telescopic sliding hood described above do not function as protrusions for the airflow. Thus, the airflow is prevented from colliding with the protrusions and the turbulence of the airflow is notably reduced.

In the dip-coating process, the coating vessel containing the coating solution is located under the member to be coated, and the solvent vapor from the coating solution keeps flowing upward, i.e., toward the member to be coated. In the present invention, since a downward airflow in the dip-coating direction is generated, the upward flow of the solvent vapor from the coating solution in the coating vessel is suppressed. As a result, the solvent vapor concentration around the coating film on the member to be coated can be lowered.

The downward airflow in the dip-coating direction can be generated by providing a suction port near the lower end of the telescopic sliding hood so that the atmosphere in the telescopic sliding hood (the gap between the inner surface of the telescopic sliding hood and the member to be coated) can be suctioned through the suction port.

When the atmosphere in the gap between the inner surface of the telescopic sliding hood and the member to be coated is suctioned from the suction port provided near the lower end of the telescopic sliding hood, the pressure in the gap between the inner surface of the telescopic sliding hood and the member to be coated decreases temporarily. To compensate the pressure-lowered state, ambient air and the like flow in through an opening provided in the upper part of the telescopic sliding hood. Alternatively, when the telescopic sliding hood is a meshed member, ambient air and the like flow in through mesh openings. As a result, an airflow that travels downward in the dip-coating direction is generated. It should be noted here that one or both of providing an opening in the upper part of the telescopic sliding hood and making the telescopic sliding hood with a meshed member may be employed.

When the air is suctioned from the suction port, the airflow tends to be turbulent near the suction port but as long as the suction port is provided near the lower end of the telescopic sliding hood and the air is suctioned from such a suction port, the effect of the turbulent airflow near the suction port on the coating film can be minimized. This is because of the following reason. The effect of the turbulent airflow on the coating film is larger when the distance between the inner surface of the telescopic sliding hood and the member to be coated is smaller. Meanwhile, the tubular member near the lower end of the telescopic sliding hood has the largest diameter among the plurality of tubular members, and the distance between the inner surface of the telescopic sliding hood and the member to be coated is the greatest near this tubular member.

Other advantages of suctioning air from the suction port to generate a downward airflow in the dip-coating direction are as follows.

That is, there is another technique for generating a downward airflow in the dip-coating direction, and this technique involves providing a blow hole near the upper end of the telescopic sliding hood so that the air is blown into the gap between the inner surface of the telescopic sliding hood and the member to be coated from the blow hole.

However, when this technique of blowing air or the like from the blowhole is employed, the airflow near the blow hole has directivity, which sometimes makes the airflow turbulent in the gap between the inner surface of the telescopic sliding hood and the member to be coated. In contrast, when the air is suctioned from the suction port as described above, the airflow is substantially free of directivity in the gap between the inner surface of the telescopic sliding hood and the member to be coated except for the position very close to the suction port. Thus, the turbulence in the airflow caused by directivity can be suppressed.

Next, the position of the suction port is described in detail.

In the case of forming a suction port near the lower end of the telescopic sliding hood, the suction port may be provided in the lowermost tubular members among the plurality of tubular members constituting the telescopic sliding hood. The lowermost tubular member is the tubular member having the largest diameter among the plurality of tubular members. Alternatively, a gap may be formed between the telescopic sliding hood and a component located thereunder (e.g., a lid of a coating vessel or a positioning member) so that this gap can be used as the suction port. This gap may be secured by providing a spacer or the like, or by suspending part of the telescopic sliding hood using a jig. Alternatively, a suction port may be formed in a member (e.g., a lid of a coating vessel or a positioning member) located under the telescopic sliding hood.

In any case, suction can be conducted at a position as low as possible to generate a downward airflow in the dip-coating direction.

In every connecting portion where one of the tubular member among the plurality of the tubular members constituting the telescopic sliding hood is connected to an adjacent tubular member at the upper side in the dip-coating direction, the step height t (mm) between the inner surfaces of the one tubular member and the adjacent tubular member and the distance d (mm) between the surface of the inner surface of the one tubular member and the member to be coated can satisfy the relationship below:

$$t \leq d \times 0.3$$

The studies conducted by the inventors have found that the degree of the turbulence in the airflow in the gap between the inner surface of the telescopic sliding hood and the member to be coated changes depending on the height of the step at the connecting portion. In particular, it has been found that the turbulence in airflow becomes smaller with the step height. It has also been found that the degree at which the solvent evaporation proceeds in the coating film in a wet state changes according to the length of the gap between the inner surface of the telescopic sliding hood and the member to be coated. To be more specific, the larger the gap, the smaller the effect of the turbulence in the airflow on the degree at which the solvent evaporation proceeds in the coating film in a wet state.

The inventors have performed experiments on the basis of such findings and found that when the dimensions of the respective parts are set to satisfy the above relationship, the effect of the present invention is particularly notable.

The present invention will now be described with reference to the drawings.

Figure 1A:
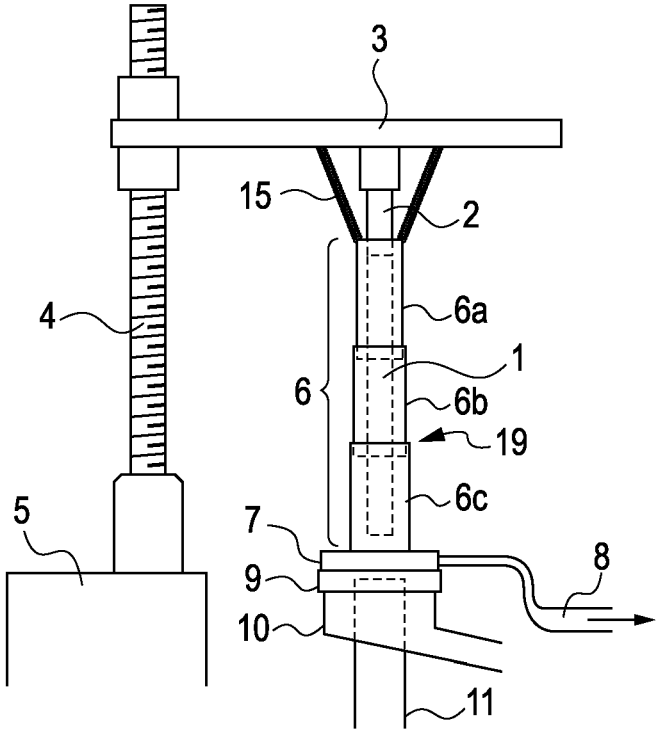
FIGS. 1A and 1B are diagrams showing one example of a coating apparatus used in a dip-coating process of the present invention.

FIG. 1A shows one example of a coating apparatus used in a dip-coating process of the present invention. The drawing shows a state in which a member 1 to be coated is lifted after immersed in a coating solution in a coating vessel 11.

The member 1 to be coated is held at its upper end portion with a chuck 2 fixed on a coating base 3 that moves up and down by rotation of a ball screw 4 installed on a base 5. An telescopic sliding hood 6 suspended with a chain 15 from the coating base 3 is arranged to cover the side surface of the member 1 to be coated.

The coating vessel 11 is filled with a coating solution (not shown) fed from a coating solution circulating apparatus (not shown). The coating solution overflows from an opening in an upper portion of the coating vessel 11, and flows back to the coating solution circulating apparatus via an overflow vessel 10. A lid 9 and a suction unit 7 are placed on the overflow vessel 10 above the coating vessel 11. The suction unit 7 has a suction port for suctioning the atmosphere between the inner surface of the telescopic sliding hood 6 and the member 1 to be coated, and the suctioned atmosphere is drawn into a suction apparatus (not shown) via a suction pipe 8.

The telescopic sliding hood 6 includes the following plurality of tubular members.

First, the telescopic sliding hood 6 includes a tubular member 6*a* at the uppermost part. A tubular member 6*b* having an inner diameter larger than the outer diameter of the tubular member 6*a* is adjacent to and is connected to the tubular member 6*a* at the lower side of the tubular member 6*a* in the dip-coating direction. A tubular member 6*c* having an inner diameter larger than the outer diameter of the tubular member 6*b* is adjacent to and is connected to the tubular member 6*b* at the lower side of the tubular member 6*b* in the dip-coating direction. Naturally, the telescopic sliding hood used in the present invention is not limited to one constituted by three tubular members, and the number of tubular members can be adequately set depending on the dimensions of the coating film to be formed and the overall structure of the coating apparatus.

Figure 1B:
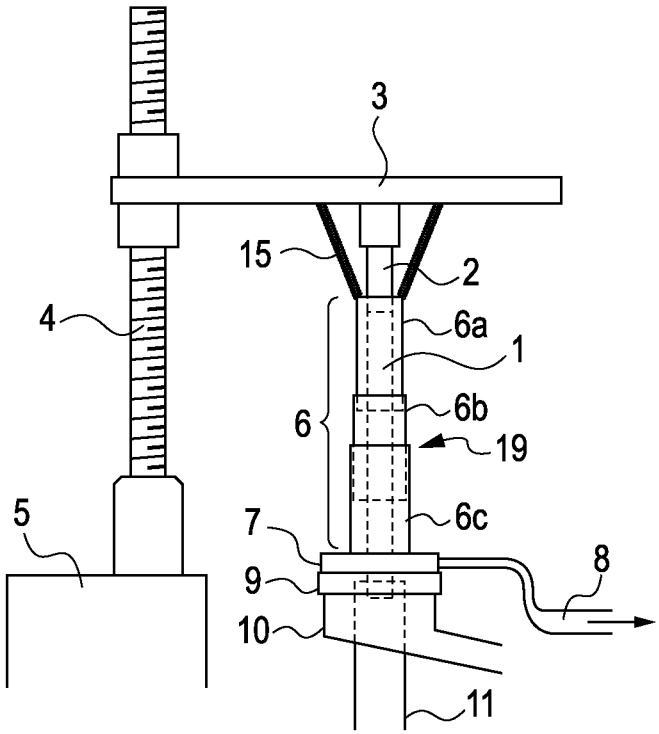

The telescopic sliding hood 6 makes contact with the suction unit 7 at the lower end of the lowermost tubular member 6*c*. The tubular member 6*c* may be placed so that it is detachable from the suction unit 7 when needed or may be fixed onto the suction unit 7. The upper end of the uppermost tubular member 6*a* of the telescopic sliding hood 6 is left open so that ambient air or the like flows into inside the telescopic sliding hood 6 through this opening when the atmosphere inside the telescopic sliding hood 6 is suctioned through the suction port of the suction unit 7. FIG. 1B shows the state during coating, in which the telescopic sliding hood 6 is being extended in association with the upward movement of the coating base 3.

As shown in FIGS. 1A and 1B, as the coating base 3 moves up and down, the member 1 to be coated is immersed in the coating solution in the coating vessel 11 and subsequently lifted so that the coating solution adheres on the surface of the member 1 to be coated. As a result, a coating film is formed on the surface of the member 1 to be coated. The telescopic sliding hood 6 can cover the side surface of the member 1 to be coated as it is extended and retracted in association with the movement during immersion and lift. The atmosphere inside the telescopic sliding hood 6 is discharged through the suction port (not shown) of the suction unit 7 to outside the telescopic sliding hood 6.

The timing at which the atmosphere inside the telescopic sliding hood 6 is discharged through the suction port of the suction unit 7 may be adequately selected depending on the physical properties of the coating solution and other various conditions related to the coating. For example, the suction may be conducted during descending movement of the coating base 3, ascending movement of the coating base 3, or both. For some formulations of the coating solution, it is effective to continue suction under the same conditions even after the coating base 3 has finished moving upward and the coating operation has finished. When suction is started during descending movement of the coating base 3, the vapor of the solvent evaporating from the coating solution in the coating vessel 11 can be constantly discharged outside the telescopic sliding hood 6. Thus, this is effective when the solvent vapor concentration in the telescopic sliding hood 6 has to be lowered during the lift. Alternatively, the suction may be started at the same time with and in association with the start of the lift, or may be delayed as needed. In order prevent the airflow from being generated or changed abruptly upon starting the suction, it is also effective to adequately alter power of suction (suction power).

Figure 2:
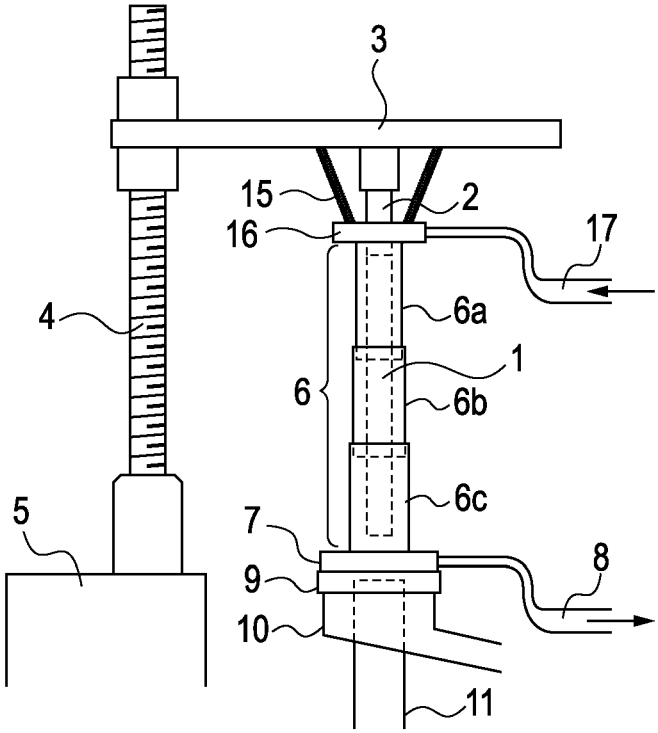
FIG. 2 is a schematic diagram showing another example of a coating apparatus used in the dip-coating process of the present invention.

FIG. 2 is diagram showing another example of a coating apparatus used in the dip-coating process of the present invention. The coating apparatus includes an air supply unit 16 on the telescopic sliding hood 6 and an air supply pipe 17 connected to the air supply unit 16. The air supply unit 16 has a blow hole (not shown) for blowing air or the like into inside the telescopic sliding hood 6. Air or the like pressure-fed from an air compressor (not shown) is introduced to the air supply unit 16 through the air supply pipe 17 and is blown into inside the telescopic sliding hood 6 through the blow hole. A filter for diffusing the blown air or the like is installed in the blow hole.

A suction unit 7 and a suction pipe 8 connected thereto similar to those shown in FIG. 1A are provided under the telescopic sliding hood 6. However, in the coating apparatus shown in FIG. 2, the suction pipe 8 need not be connected to the suction apparatus described with reference to FIG. 1A. In the case where the suction pipe 8 is not connected to the suction apparatus, the airflow in the gap between the inner surface of the telescopic sliding hood 6 and the member to be coated is generated by the air or the like blown in from the blow hole of the air supply unit 16.

Figure 3:
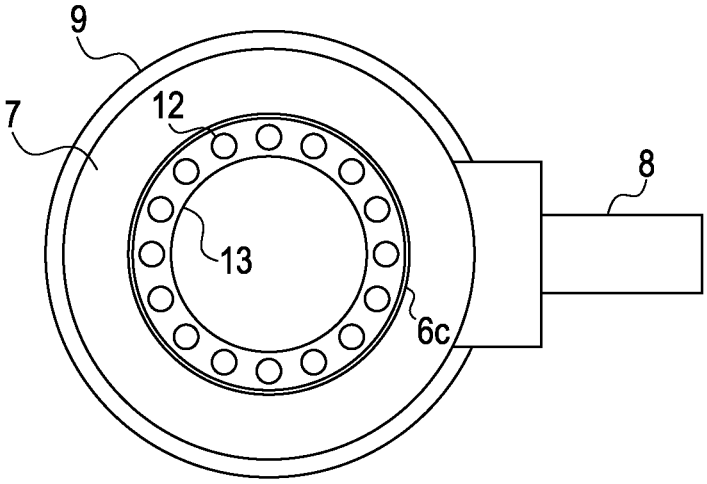
FIG. 3 is a diagram showing details of a portion where the atmosphere in the gap between the inner surface of a telescopic sliding hood and a member to be coated is suctioned.
Figure 4:
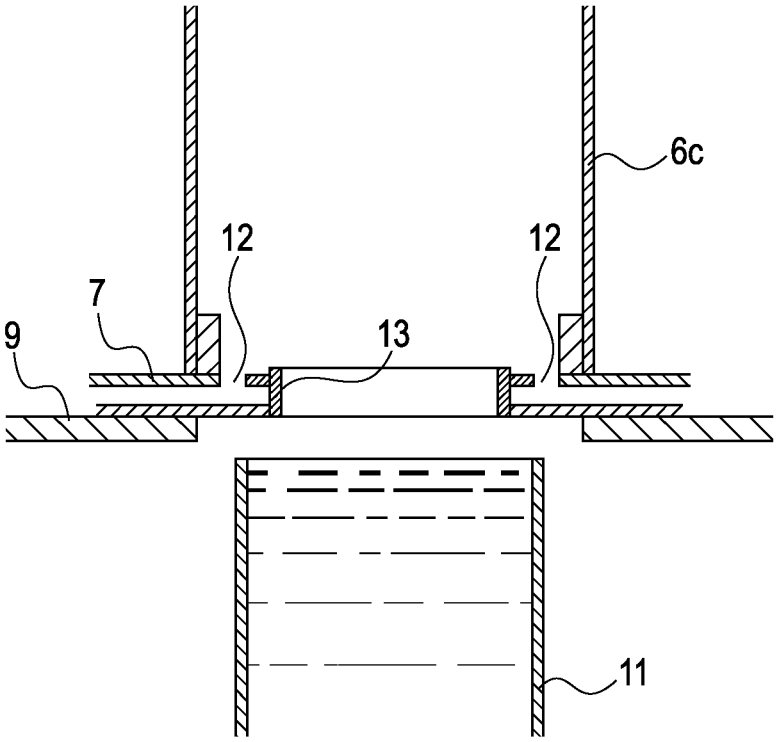
FIG. 4 is another diagram showing details of the portion where the atmosphere in the gap between the inner surface of a telescopic sliding hood and a member to be coated is suctioned.

FIGS. 3 and 4 show details of a portion where the atmosphere in the gap between the inner surface of the telescopic sliding hood and the member to be coated is suctioned. FIG. 3 is a plan view taken from above, and FIG. 4 is a cross-sectional view. The suction unit 7 has suction ports 12. As shown in FIGS. 3 and 4, the suction ports 12 are located between the lowermost tubular member 6*c* of the telescopic sliding hood and an insertion hole 13 that allows the member 1 to be coated to pass through. Alternatively, the suction ports 12 may be provided in the lower part of the tubular member 6*c*, in the inner peripheral surface of the insertion hole 13 having a cylindrical shape, or a lower surface side of the suction unit 7. As for the shape and arrangement of the suction ports 12, a plurality of round holes may be evenly arranged as shown in FIG. 3, a plurality of elongate holes may be arranged evenly, or a plurality of slits may be arranged. The function of the suction ports 12 is to suction the atmosphere in the gap between the inner surface of the telescopic sliding hood 6 and the member to be coated, and during the suction, the atmosphere should be evenly suctioned. In the case where a plurality of round holes are arranged evenly as shown in FIG. 3, the diameter of each hole can be made as small as possible while securing the desired amount of suction. This is because the unevenness in suction amount derived from the positional relationship between the suction pipe 8 and the suction ports 12 can be moderated.

FIGS. 5A and 5B are cross-sectional views showing the gap between the member 1 to be coated and the connecting portion between the tubular member 6*b* and the tubular member 6*c* of the telescopic sliding hood in the portion marked by arrow 19 in FIG. 1.

FIG. 5A shows the connecting portion between the tubular members connected by hooking. FIG. 5B shows a connecting portion that has no overlap margin because the respective tubular members are connected at a predetermined interval with wires or the like.

In FIG. 5A, the tubular member 6*b* has, at its lower end, a ring member 14*b* having a larger diameter, and the tubular member 6*c* has, at its upper end, a ring member 14*c* having a smaller diameter. The tubular member 6*b* is connected to the tubular member 6*c* by hooking the ring member 14*b* with the ring member 14*c*. The inner diameter of the ring member 14*c* is designed to be slightly larger than the outer diameter of the cylinder portion of the tubular member 6*b* and the outer diameter of the ring member 14*b* is designed to be slightly smaller than the inner diameter of the cylinder portion of the tubular member 6*c*, thereby creating a gap.

In FIG. 5B also, the tubular member 6*b* has an outer diameter slightly smaller than the inner diameter of the tubular member 6*c*, thereby creating a gap.

These gaps are sliding gaps that allow the tubular member 6*b* and the tubular member 6*c* to slide smoothly and enable extension and retraction of the telescopic sliding hood. The airflow generated in the gap between the inner surface of the telescopic sliding hood and the member 1 to be coated is an airflow that travels downward in the drawing of FIG. 5.

However, while this sliding gap allows the telescopic sliding hood to extend and retract, it can serve as an entrance path for the air or the like from outside the telescopic sliding hood when an airflow travelling downward in the drawing is generated by suction using the suction unit 7. The structure shown in FIG. 5A is advantageous in that when it is employed in the connecting portion between the tubular members, entry of air or the like from outside the telescopic sliding hood can be prevented by the overlap between the two ring members. Note that the amount of air or the like entering from outside the telescopic sliding hood is determined by the ratio of the length of the sliding gap to the length of the gap between the inner surface of the telescopic sliding hood and the member 1 to be coated. Thus, the sliding gap can be designed to be as small as possible. The sliding gap can be sufficiently made small by avoiding use of tubular members with poor accuracy.

The step height t in FIG. 5A is the sum of the wall thickness of the tubular member 6*b* (the total thickness of the cylinder portion of the tubular member 6*b* and the ring member 14*b*) and the length of the sliding gap described above.

In FIGS. 5A and 5B, the degree of turbulence in the airflow in the gap between the inner surface of the telescopic sliding hood and the member to be coated changes with the step height t. The smaller the step height t, the smaller the degree of turbulence in the airflow.

The effect of turbulence in the airflow on the degree of progress of the solvent evaporation from the coating film in a wet state changes depending on the distance d between the inner surface of the telescopic sliding hood and the surface of the member 1 to be coated. To be more specific, the larger the distance d, the smaller the effect of the turbulence in the airflow on the degree at which the solvent evaporation proceeds in the coating film in a wet state.

Figure 6:
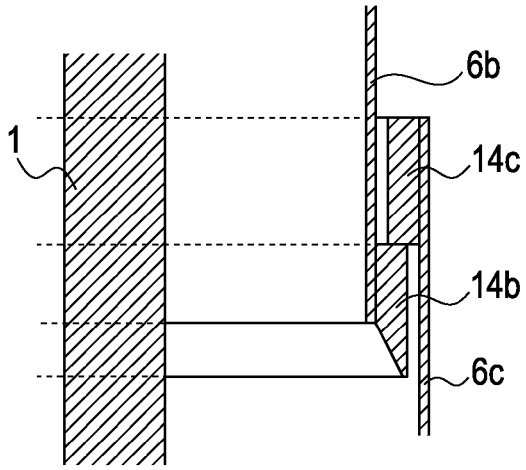
FIG. 6 is another cross-sectional view showing a gap between a member to be coated and a connecting portion between one tubular member and an adjacent tubular member of a telescopic sliding hood.

FIG. 6 is a diagram showing the gap between the member 1 to be coated and the connecting portion between the tubular member 6*b* and the tubular member 6*c* of the telescopic sliding hood. The ring member 14*b* is different from one shown in FIG. 5A. As shown in FIG. 6, the inner lower part of the ring member 14*b* is processed, e.g., beveled or tapered, to effectively suppress the turbulence in the airflow.

The descriptions made by referring to FIGS. 5A, 5B, and 6 also apply to the connecting portion between the tubular member 6*a* and the tubular member 6*b* and to the cases where the number of tubular members is 2 or 4 or more.

Examples of the tubular member include cylindrical members and prismatic members. When the member to be coated is cylindrical (columnar), the tubular member can be a cylindrical member. In Examples and Comparative Examples described below, the member to be coated is cylindrical and thus cylindrical members are used as the tubular members.

The method for making an electrophotographic photosensitive member incorporating the dip-coating process of the present invention will now be described.

In general, an electrophotographic photosensitive member is made by forming a photosensitive layer on a supporting member. The photosensitive layer may be a single-layer photosensitive layer containing both a charge transport substance and a charge generation substance, or a multilayer (separated-function) photosensitive layer functionally divided into a charge generation layer containing a charge generation substance and a charge transport layer containing a charge transport substance. In viewpoints of electrophotographic properties, the photosensitive layer can be a multilayer photosensitive layer. Among multilayer photosensitive members, one produced by layering a charge generation layer on a supporting member and layering a charge transport layer on the charge generation layer (regular layer type photosensitive layer) can be used. A conductive layer or an intermediate layer described below may be provided between the supporting member and the photosensitive layer. A protective layer described below may be disposed on the photosensitive layer.

Note that the "coating film" described above may be a conductive layer, an intermediate layer, a photosensitive layer (charge generation layer or charge transport layer), a protective layer, or any other layer. The "member to be coated" described above is a base having a surface on which the "coating film" is to be formed. For example, when the electrophotographic photosensitive member is formed by sequentially layering a conductive layer, an intermediate layer, a charge generation layer, a charge transport layer, and a protective layer on a supporting member in that order, the "member to be coated" is the supporting member in forming the conductive layer as the "coating film". Likewise, the "member to be coated" is the supporting member with the conductive layer in forming the intermediate layer as the "coating film", the "member to be coated" is the supporting member with the conductive layer and the intermediate layer sequentially formed thereon in forming the charge generation layer as the "coating film", the "member to be coated" is the supporting member with the conductive layer, the intermediate layer, and the charge generation layer sequentially formed thereon in forming the charge transport layer as the "coating film", and the "member to be coated" is the supporting member with the conductive layer, the intermediate layer, the charge generation layer, and the charge transport layer sequentially formed thereon in forming the protective layer as the "coating film".

The making method of the present invention can be applied to making any "coating film" described above, and may be used to form a plurality of layers. However, the method is particularly suitable for making an intermediate layer, a charge generation layer, and a protective layer as the "coating film" since the viscosity of the coating solutions for making these layers is relatively low due to the material and thickness.

Detailed description is provided below by using an electrophotographic photosensitive member having a multilayer photosensitive layer as an example.

The supporting member may be any member having electrical conductivity (conductive supporting member). Examples thereof include metal (alloy) supporting members such as aluminum, aluminum alloy, copper, zinc, stainless steel, vanadium, molybdenum, chromium, titanium, nickel, indium, gold, and platinum supporting members. Metal supporting members having layers made by vapor-depositing these metals (alloy) in vacuum and plastic (polyethylene resin, polypropylene resin, polyvinyl chloride resin, polyethylene terephthalate resin, acryl resin, etc.) supporting members may also be used. Supporting members made by impregnating plastics or paper with conductive particles such as carbon black, tin oxide particles, titanium oxide particles, and silver particles along with adequate binding resins, and plastic supporting members having conductive binding resins may also be used.

The supporting member may be cylindrical, seamless belt (endless belt)-like, etc., in shape. The supporting member can be cylindrical in shape.

The surface of the supporting member may be machined, roughened, anodized, etc., to prevent interference patterns caused by scattering of laser light or the like.

A conductive layer may be formed between the supporting member and the photosensitive layer (charge generation layer or charge transport layer) or between the supporting member and the intermediate layer described below to prevent inference patterns caused by scattering of laser light and to cover the defects of the supporting member.

The conductive layer may be formed by dispersing conductive particles, such as carbon black, metal particles, or metal oxide particles, into a binding resin.

The thickness of the conductive layer can be 1 to 40 μm and more particularly 2 to 20 μm.

An intermediate layer having a barrier function or an adhesive function may be provided between the supporting member and the photosensitive layer (charge generation layer or charge transport layer) or between the conductive layer and the photosensitive layer (charge generation layer or charge transport layer). The intermediate layer is formed to improve the adhesion of the photosensitive layer, coatability, and property of injecting charges from the supporting member and to protect the photosensitive layer from electric breakdown etc.

Examples of the material that can be used to form the intermediate layer include resins such as acryl resin, allyl resin, alkyd resin, ethylcellulose resin, ethylene-acrylic acid copolymer, epoxy resin, casein resin, silicone resin, gelatin resin, phenol resin, butyral resin, polyacrylate resin, polyacetal resin, polyamideimide resin, polyamide resin, polyallyl ether resin, polyimide resin, polyurethane resin, polyester resin, polyethylene resin, polycarbonate resin, polystyrene resin, polysulfone resin, polyvinyl alcohol resin, polybutadiene resin, polypropylene resin, and urea resin; and aluminum oxide. The intermediate layer may contain a metal, an alloy, an oxide of a metal or an alloy, a salt, a surfactant, etc.

The thickness of the intermediate layer can be 0.05 to 7 μm and, in particular, 0.1 to 2 μm.

The charge generation layer can be formed by applying a charge generation layer-forming coating solution prepared by dispersing a charge generation substance with a binding resin and a solvent, and then drying and/or curing the applied coating solution under heating and/or radiation irradiation. Examples of the dispersion techniques include those that use homogenizers, ultrasonic dispersers, ball mills, sand mills, roll mills, vibration mills, attritors, and liquid collision high speed dispersers.

Examples of the charge generation substance include azo pigments such as monoazo, disazo, and trisazo pigments; phthalocyanine pigments such as metal phthalocyanines and non-metal phthalocyanines; indigo pigments such as indigo and thioindigo; perylene pigments such as perylene anhydrides and perylene imide; polycyclic quinone pigments such as anthraquinone and pyrenequinone; squarylium dyes; pyrylium salts and thiapyrylium salts; triphenylmethane pigments; inorganic substances such as selenium, selenium-tellurium, and amorphous silicon; quinacridone pigments; azulenium salt pigments; cyanine dyes; xanthene dyes; quinoneimine dyes; styryl dyes; cadmium sulfide; and zinc oxide. These charge generation substances may be used alone or in combination.

Examples of the binding resin used in the charge generation layer include acryl resin, allyl resin, alkyd resin, epoxy resin, diallylphthalate resin, silicone resin, styrene-butadiene copolymer, phenol resin, butyral resin, benzal resin, polyacrylate resin, polyacetal resin, polyamideimide resin, polyamide resin, polyallyl ether resin, polyarylate resin, polyimide resin, polyurethane resin, polyester resin, polyethylene resin, polycarbonate resin, polystyrene resin, polysulfone resin, polyvinyl acetal resin, polybutadiene resin, polypropylene resin, methacryl resin, urea resin, vinyl chloride-vinyl acetate copolymer, and vinyl acetate resin. Butyral resin can be used in particular. These binding resins can be used alone, or in combination as a mixture or a copolymer.

The ratio of the binding resin in the charge generation layer can be 90 mass % or less and, in particular, 50 mass % or less of the entire mass of the charge generation layer.

The solvent used in the charge generation layer-forming coating solution is selected on the basis of the binding resin used and the solubility and dispersion stability of the charge generation substance used. Examples of the organic solvent include alcohols, sulfoxides, ketones, ethers, esters, aliphatic halogenated hydrocarbons, and aromatic compounds.

The thickness of the charge generation layer can be 0.001 to 6 μm and, in particular, 0.01 to 1 μm.

Various sensitizers, antioxidants, UV absorbers, and plasticizers may be added to the charge generation layer if necessary.

The charge transport layer can be formed by applying a charge transport layer-forming coating solution prepared by dissolving a charge transport substance and a binding resin in a solvent, and then drying and/or curing the applied coating solution under heating and/or radiation irradiation.

Examples of the charge transport substance include triarylamine compounds, hydrazone compounds, styryl compounds, stilbene compounds, pyrazoline compounds, oxazole compounds, thiazole compounds, and triarylmethane compounds. These charge transport substances may be used alone or in combination.

The ratio of the charge transport substance in the charge transport layer can be 20 to 80 mass % and, in particular, 30 to 70 mass % of the entire mass of the charge transport layer. Accordingly, the charge transport layer-forming coating solution can contain the charge transport substance in an amount that the ratio of the charge transport substance after formation of the charge transport layer is within the above-described range.

Examples of the binding resin used in the charge transport layer include acryl resin, acrylonitrile resin, allyl resin, alkyd resin, epoxy resin, silicone resin, phenol resin, phenoxy resin, butyral resin, polyacrylamide resin, polyacetal resin, polyamideimide resin, polyamide resin, polyallyl ether resin, polyarylate resin, polyimide resin, polyurethane resin, polyester resin, polyethylene resin, polycarbonate resin, polystyrene resin, polysulfone resin, polyvinyl butyral resin, polyphenylene oxide resin, polybutadiene resin, polypropylene resin, methacryl resin, urea resin, vinyl chloride resin, and vinyl acetate resin. Polyarylate resin and polycarbonate resin can be used in particular. These binding resins can be used alone, or in combination as a mixture or a copolymer.

The ratio of the charge transport substance to the binding resin can be in the range of 5:1 to 1:5 (on amass basis).

Examples of the solvent used in the charge transport layer-forming coating solution include monochlorobenzene, dioxane, toluene, xylene, N-methylpyrrolidone, dichloromethane, tetrahydrofuran, and methylal.

If necessary, antioxidants, UV absorbers, and plasticizers may be added to the charge transport layer.

A protective layer that protects the photosensitive layer may be formed on the photosensitive layer. The protective layer can be formed by applying a protective layer-forming coating solution prepared by dissolving any of the above-described binding resins in a solvent, and then drying and/or curing the applied coating solution under heating and/or radiation irradiation.

The surface layer of the electrophotographic photosensitive member may contain a lubricant. Examples of the lubricant include polymers, monomers, and oligomers containing silicon atoms or fluorine atoms.

Specific examples thereof include N-(n-propyl)-N-(β-acryloxyethyl)-perfluorooctyl sulfonic acid amide, N-(n-propyl)-(β-methacryloxyethyl)-perfluorooctyl sulfonic acid amide, perfluorooctane sulfonic acid, perfluorocaprylic acid, N-n-propyl-n-perfluorooctanesulfonic acid amide-ethanol, 3-(2-perfluorohexyl)ethoxy-1,2-dihydroxypropane, and N-n-propyl-N-2,3-dihydroxypropyl perfluorooctylsulfonamide. Examples of the fluorine atom-containing resin particles include polytetrafluoroethylene, polychlorotrifluoroethylene, polyvinylidene fluoride, polydichlorodifluoroethylene, tetrafluoroethylene-perfluoroalkylvinyl ether copolymer, tetrafluoroethylene-hexafluoropropylene copolymer, tetrafluoroethylene-ethylene copolymer, and tetrafluoroethylene-hexafluoropropylene-perfluoroalkylvinyl ether copolymer. These can be used alone or in combination as a mixture. The number-average molecular weight of the lubricant can be 3000 to 5000000 and, in particular, 10000 to 3000000. When the lubricant is in the form of particles, the average particle diameter can be 0.01 to 10 μm and, in particular, 0.05 to 2.0 μm.

The surface layer of the electrophotographic photosensitive member may contain a resistance adjustor. Examples of the resistance adjustor include $SnO_2$, ITO, carbon black, and silver particles. These may be hydrophobized and used. The resistance of the surface layer containing the resistance adjustor can be $10^9$ to $10^{14}$ Ω·cm.

In the case where the protective layer is provided, the protective layer serves as the surface layer of the electrophotographic photosensitive member. In the case where no protective layer is formed and the photosensitive layer is a regular layer type photosensitive layer, the charge transport layer serves as the surface layer of the electrophotographic photosensitive member. In the case where no protective layer is formed and the photosensitive layer is a reverse layer type photosensitive layer, the charge generation layer serves as the surface layer of the electrophotographic photosensitive member.

Figure 9:
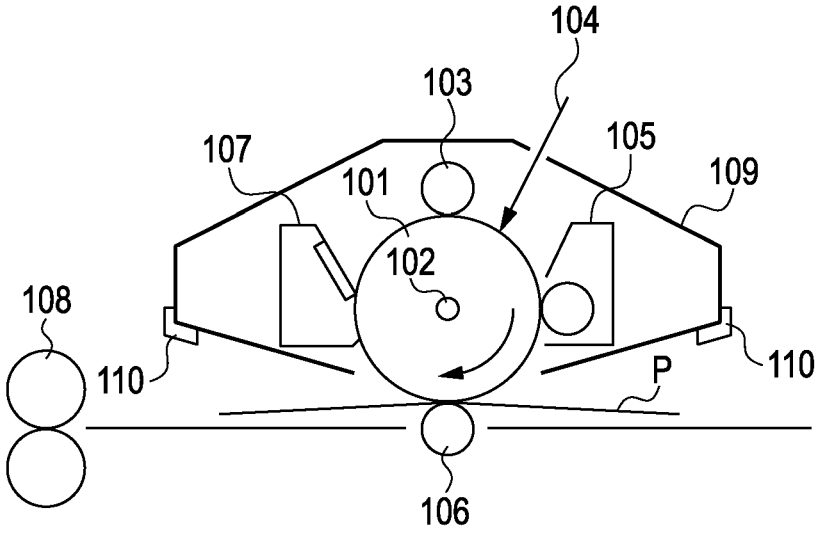
FIG. 9 is a schematic diagram showing an overall structure of an example of an electrophotographic apparatus equipped with a process cartridge that includes an electrophotographic photosensitive member made by the method of the present invention.

FIG. 9 shows an overall structure of an example of an electrophotographic apparatus equipped with a process cartridge that includes an electrophotographic photosensitive member made by the method of the present invention.

Referring to FIG. 9, a cylindrical electrophotographic photosensitive member 101 is driven and rotated about a shaft 102 at a particular peripheral velocity in the direction indicated by an arrow.

The surface of the rotating electrophotographic photosensitive member 101 is evenly charged to a particular positive or negative electric potential by a charging unit (primary charging unit such as a charging roller) 103. Next, the surface of the electrophotographic photosensitive member 101 is irradiated with exposure light (image exposure light) 104 output from an exposure unit (not shown) employing a slit exposure technique, a laser beam scanning exposure technique, or the like. As a result, electrostatic latent images corresponding to a target image are sequentially formed on the surface of the electrophotographic photosensitive member 101.

The electrostatic latent images formed on the surface of the electrophotographic photosensitive member 101 are developed with toner contained in a developer of a developing unit 105 to form toner images. Then the toner images formed and carried on the surface of the electrophotographic photosensitive member 101 are transferred to a transfer material (such as paper) P one by one by a transfer bias from a transfer unit (such as transfer roller) 106. Note that the transfer material P is fed from a transfer material feeder (not shown) to a nip (contact portion) between the electrophotographic photosensitive member 101 and the transfer unit 106 in synchronization with the rotation of the electrophotographic photosensitive member 101.

The transfer material P onto which the toner images have been transferred is separated from the surface of the electrophotographic photosensitive member 101, introduced into a fixing unit 108 to have the images fixed thereon, and discharged outside the apparatus as an image-formed material (print or copy).

The surface of the electrophotographic photosensitive member 101 after toner image transfer is cleaned by a cleaning unit (such as a cleaning blade) 107 to remove the developer (toner) left after the transfer. Then the surface of the electrophotographic photosensitive member 101 is subjected to charge elimination with preexposure light (not shown) from a preexposure unit (not shown) and repeatedly used for image formation. As shown in FIG. 9, when the charging unit 103 is a contact charging unit that uses a charging roller or the like, preexposure is not always necessary.

Some of the constitutional elements selected from the electrophotographic photosensitive member 101, the charging unit 103, the developing unit 105, the transfer unit 106, and the cleaning unit 107 may be housed in a casing to be integrated into one process cartridge, and this process cartridge may be designed to be freely mountable on the main body of the electrophotographic apparatus such as a copy machine or a laser beam printer. In FIG. 9, the electrophotographic photosensitive member 101, the charging unit 103, the developing unit 105, and the cleaning unit 107 are integrated into a process cartridge 109 that is freely detachable from the main body of the electrophotographic apparatus by using a guiding unit 110 such as a rail of the main body of the electrophotographic apparatus.

The present invention will now be described in further detail by using non-limiting specific examples. Note that "parts" referred to in Examples means "parts by weight".

Coating solutions used for making the electrophotographic photosensitive member and the methods for making and evaluating the electrophotographic photosensitive member are described below.

<Preparation of Intermediate Layer-Forming Coating Solution 1>

In a hot-water bath at 60° C., 22.5 parts of N-methoxymethylated 6-nylon resin (trade name: Toresin EF-30T produced by Nagase ChemteX Corporation, degree of polymerization: 420, methoxymethylation ratio: 36.8%) was dissolved in 127.5 parts of ethanol (produced by Kishida Chemical Co., Ltd., special grade) under heating and stirring. The solution was then left to stand still in an environment at a temperature of 23° C. and a relative humidity of 50% for 12 hours to obtain a gelled polyamide resin GA.

The gelled polyamide resin GA (130.0 parts) was filtered by being pressed against a sieve (sieve opening: 0.5 mm) to crush the gelled polyamide resin GA to 1 mm or less. To the crushed gelled polyamide resin GA, 50.0 parts of ethanol (produced by Kishida Chemical Co., Ltd., special grade) and 0.130 parts of a diazo compound represented by structural formula (1) below were added, and a mixture liquid before dispersion was obtained.

Structural formula (1)

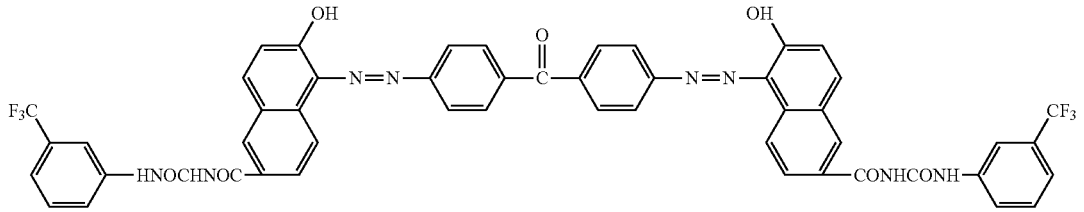

The mixture liquid was dispersed in a vertical sand mill containing 500 parts of glass beads with an average diameter of 0.8 mm as the dispersion media at a rotation rate of 1500 rpm (peripheral velocity of 5.5 m/s) for 4 hours to obtain dispersion A.

Dispersion A was diluted with 220.3 parts of ethanol (produced by Kishida Chemical Co., Ltd., special grade) and 253.9 parts of n-butanol to prepare intermediate layer-forming coating solution 1.

<Preparation of Intermediate Layer-Forming Coating Solution 2>

A mixture containing 5 parts of nylon 6-66-610-12 quaternary nylon copolymer resin (trade name: CM8000 produced by Toray Industries, Inc.), 15 parts of N-methoxymethylated 6-nylon resin (trade name: Toresin EF-30T produced by Nagase ChemteX Corporation, degree of polymerization: 420, methoxymethylation ratio: 36.8%), 450 parts of methanol (Kishida Chemical Co., Ltd., special grade), and 200 parts of n-butanol (Kishida Chemical Co., Ltd., special grade) was dispersed in a sand mill containing glass beads 0.8 mm in diameter for 4 hours to prepare intermediate layer-forming coating solution 2.

<Preparation of Charge Generation Layer-Forming Coating Solution>

To 250 parts of cyclohexanone, 10 parts of hydroxygallium phthalocyanine (charge generation substance) represented by structural formula (2) below, Structural formula (2)

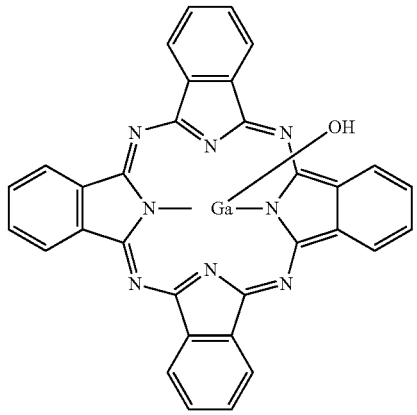

0.1 parts of a compound represented by structural formula (3) below

Structurual formula (3)

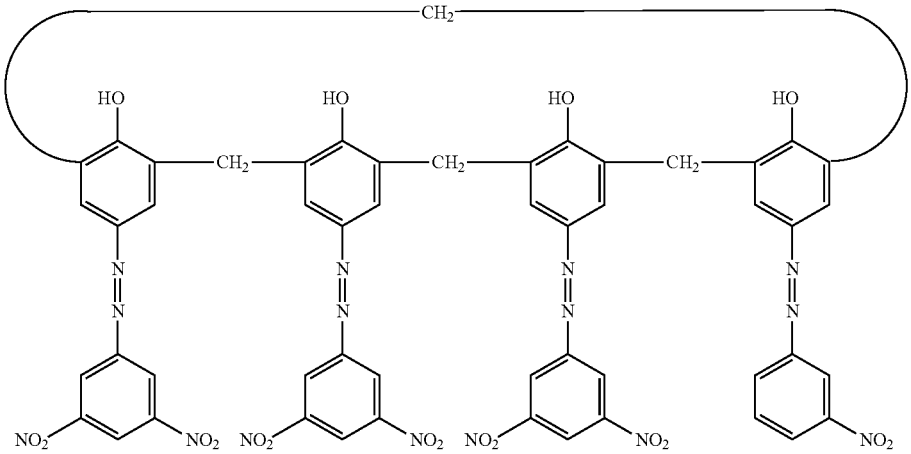

and 5 parts of polyvinyl butyral resin (trade name: S-LEC BX-1 produced by Sekisui Chemical Co., Ltd.) were added, and the mixture was dispersed for 3 hours in a sand mill using glass beads 0.8 mm in diameter. As a result of this operation, a dispersion containing hydroxygallium phthalocyanine crystals of a type having sharp peaks at Bragg angles (2θ±0.2°) of 7.5°, 9.9°, 16.3°, 18.6°, 25.1°, and 28.3° in an X-ray diffractogram (CuKα) was obtained. The dispersion was diluted with 100 parts of cyclohexanone and 450 parts of ethyl acetate to prepare a charge generation layer-forming coating solution.

<Preparation of Charge Transport Layer-Forming Coating Solution>

Into 70 parts of monochlorobenzene, 10 parts of a compound (charge transport substance) represented by structural formula (4) below, Structural formula (4)

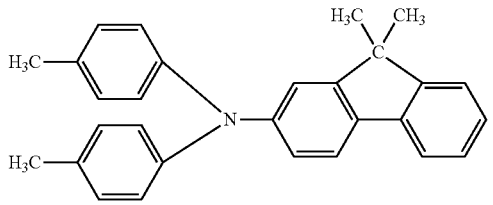

and 10 parts of polycarbonate resin (trade name: Iupilon Z-200, produced by Mitsubishi Engineering-Plastics Corporation) were dissolved to prepare a charge transport layer-forming coating solution.

EXAMPLE 1

<Formation of Intermediate Layer 1>

A coating apparatus shown in FIGS. 2 and 5A was used to dip-coat an aluminum cylindrical supporting member having an outer diameter of 30 mm and a length of 357.5 mm with intermediate layer-forming coating solution 1 described above, and the coating solution was dried for 10 minutes at 100° C. to form an intermediate layer having a thickness of 0.8 μm. This was Coating Sample α (cylindrical).

Air was blown into inside the telescopic sliding hood 6 by the air supply unit 16 according to the following operation.

Blowing of the air was started when the coating base 3 and the member 1 to be coated started to descend. After the member 1 to be coated was immersed in the coating solution in the coating vessel 11, it was lifted, and blowing of air was continued until the lower end of the member 1 to be coated was past the surface of the coating solution in the coating vessel 11 and above the suction unit 7. The rate of airflow created by the blown air in the gap between the inner surface of the telescopic sliding hood 6 and the member 1 to be coated was set as follows.

While the member 1 to be coated was held with the chuck 2 and air was blown from the air supply unit 16, smoke was introduced from the midway of the air supply pipe 17 using a smoke flow marker, and the time taken for the smoke to travel from the upper end of the cylindrical member 6*a* to the lower end of the cylindrical member 6*c* was measured. The distance from the opening at the upper end of the cylindrical member 6*a* to the lower end of the cylindrical member 6*c* at the time when the measurement was taken was 370 mm, and the amount of blow was adjusted so that the smoke travels this distance in 6 seconds. The amount of blow was adjusted by an air volume controlling valve installed at the end of the air supply pipe 17. In all Examples and Comparative Examples described below, the airflow rate was adjusted to be the same irrespective of the direction of the airflow in conducting the dip-coating.

The inner diameters of the cylindrical members 6*a*, 6*b*, and 6*c* of the telescopic sliding hood 6 were as shown in Table 1. The inner diameter is the dimension excluding the ring member. Ring members used were made so that the step height at each of the joints between the cylindrical members 6*a* and 6*b* and between the cylindrical members 6*b* and 6*c* was as shown in Table 1.

Such a coating operation was repeated 20 times to prepare twenty Coating Samples α. The appearance was visually investigated and rated as follows according to the level of shade variation. The results are shown in Table 1.

A: No shade variation was observed.

B: Slight shade variation was observed.

C: Moderate shade variation was observed.

D: Shade variation was readily identifiable.

<Formation of Charge Generation Layer>

All A-rated Coating Samples α were used.

The same coating apparatus as that used in forming the intermediate layer was used. Under the same conditions, each of Coating Samples α was dip-coated with the charge generation layer-forming coating solution and the coating solution was dried for 10 minutes at 100° C. to form a charge generation layer having a thickness of 0.2 This was Coating Sample β (cylindrical).

The appearance of all Coating Samples β was visually investigated and rated as with Coating Samples α. The results are shown in Table 1.

Likewise, charge generation layers were formed on the remaining Coating Samples α (those not rated A) to prepare Coating Samples β.

<Fabrication of Electrophotographic Photosensitive Members by Forming Charge Transport Layers>

All of Coating Samples β were used.

The same coating apparatus as that used in forming the intermediate layer was used. Under the same conditions, each of coating samples β was dip-coated with the charge transport layer-forming coating solution and the coating solution was dried for 1 hour at 110° C. to form a charge transport layer having a thickness of 25 μm. As a result, a cylindrical electrophotographic photosensitive member was obtained.

<Image Evaluation>

Image evaluation was conducted by loading the resulting electrophotographic photosensitive members on a digital copier, IR-400 (trade name) produced by Canon Inc.

As for the evaluation results, those samples that gave output images completely free of unevenness were rated "No unevenness", those samples that gave output images with minor unevenness were rated "Slight unevenness", and those samples that gave output images with readily identifiable unevenness were rated "Substantial unevenness". The results are shown in Table 2.

EXAMPLE 2

Coating Samples α, Coating Samples β, and electrophotographic photosensitive members were fabricated and evaluated as in Example 1 except that intermediate layer-forming coating solution 2 was used in forming the intermediate layer. The results are shown in Tables 1 and 2.

COMPARATIVE EXAMPLE 1

Coating Samples α, Coating Samples β, and electrophotographic photosensitive members were fabricated and evaluated as in Example 1 except that in applying the intermediate layer-forming coating solution, the charge generation layer-forming coating solution, and the charge transport layer-forming coating solution by dip-coating, an airflow was not generated in the gap between the inner surface of the telescopic sliding hood 6 and the member to be coated. The results are shown in Tables 1 and 2.

COMPARATIVE EXAMPLE 2

Figure 7:
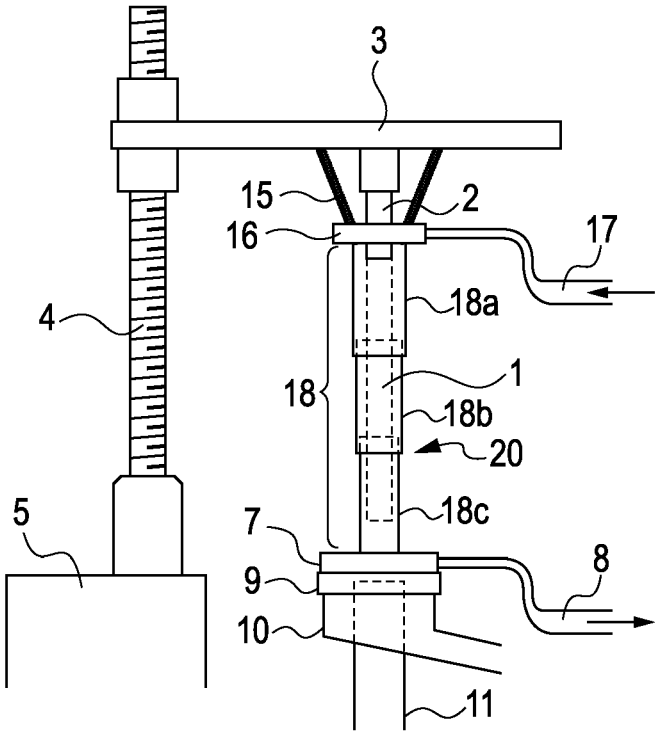
FIG. 7 is a diagram showing a coating apparatus used in Comparative Examples.

Coating Samples α, Coating Samples β, and electrophotographic photosensitive members were fabricated and evaluated as in Example 1 except that in applying the intermediate layer-forming coating solution, the charge generation layer-forming coating solution, and the charge transport layer-forming coating solution by dip-coating, the coating apparatus shown in FIG. 7 was used. The results are shown in Tables 1 and 2.

The coating apparatus shown in FIG. 7 was different from the coating apparatus shown in FIG. 2 in that the telescopic sliding hood was turned upside down. In other words, a telescopic sliding hood 18 shown in FIG. 7 includes a plurality of tubular members connected so that their diameters successively decrease downward in the dip-coating direction. The connecting portions between the tubular members of the telescopic sliding hood 18 have a structure shown in FIG. 8, which is upsidedown compared to FIG. 4A.

Figure 8:
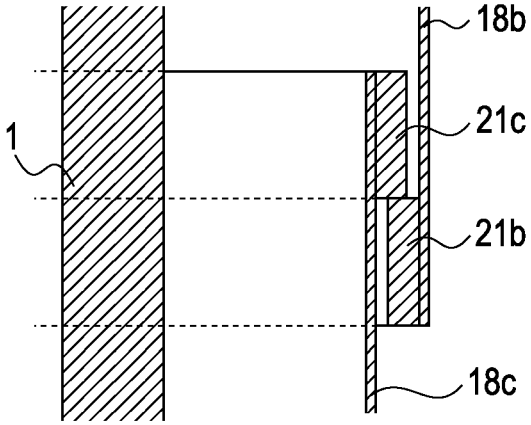
FIG. 8 is a cross-sectional view showing a gap between a member to be coated and a connecting portion between one tubular member and an adjacent tubular member of a telescopic sliding hood.

FIG. 8 is a diagram showing the portion marked by arrow 20 in FIG. 7 where there is a gap between the member 1 to be coated and the connecting portion between a tubular member 18*b* and a tubular member 18*c* of the telescopic sliding hood. The tubular member 18*c* has, at its upper end, a ring member 21*c* having a larger diameter, and the tubular member 18*b* has, at its lower end, a ring member 21*b* having a smaller diameter. The tubular member 18*b* is connected to the tubular member 18*c* by hooking the ring member 21*b* with the ring member 21*c*. The inner diameter of the ring member 21*b* is controlled to be slightly larger than the outer diameter of the cylinder portion of the tubular member 18*c* and the outer diameter of the ring member 21*c* is controlled to be slightly smaller than the inner diameter of the cylinder portion of the tubular member 18*b*, thereby creating a gap.

In Comparative Example 2, air was blown into inside the telescopic sliding hood 18 from a blow hole in the air supply unit 16 to generate a downward airflow in the dip-coating direction in the gap between the inner surface of the telescopic sliding hood 18 and the member 1 to be coated.

COMPARATIVE EXAMPLE 3

Coating Samples α, Coating Samples β, and electrophotographic photosensitive members were fabricated and evaluated as in Example 1 except that in applying the intermediate layer-forming coating solution, the charge generation layer-forming coating solution, and the charge transport layer-forming coating solution by dip-coating, the coating apparatus shown in FIG. 7 was used. The coating apparatus used was the same as in Comparative Example 2. However, before carrying out the dip-coating operation, the air supply unit 16 and the air supply pipe 17 were removed from the coating apparatus shown in FIG. 7, and an air compressor (not shown) was attached at the end of the suction pipe 8 so that the air blew into inside the telescopic sliding hood 18 from the suction port of the suction unit 7. In other words, the suction unit 7 was used as the air supply unit, and the suction port was used as the blow hole. The results are shown in Tables 1 and 2.

COMPARATIVE EXAMPLE 4

Coating Samples α, Coating Samples β, and electrophotographic photosensitive members were fabricated and evaluated as in Example 1 except that a coating apparatus shown in FIG. 2 was used to apply the intermediate layer-forming coating solution and the charge generation layer-forming coating solution. The coating apparatus used was the same as in Example 1. However, before carrying out the dip-coating operation, the air supply unit 16 and the air supply pipe 17 were removed from the coating apparatus shown in FIG. 2, and an air compressor (not shown) was attached at the end of the suction pipe 8 so that the air blew into inside the telescopic sliding hood 6 from the suction port of the suction unit 7. In other words, the suction unit 7 was used as the air supply unit, and the suction port was used as the blow hole. The results are shown in Tables 1 and 2.

EXAMPLE 3

Coating Samples α and Coating Samples β were fabricated as in Example 1 except that in applying the intermediate layer-forming coating solution and the charge generation layer-forming coating solution by dip-coating, the coating apparatus shown in FIGS. 1A and 5A was used. The results are shown in Table 1. However, a downward airflow in the dip-coating direction was generated by suctioning the atmosphere in the gap between the inner surface of the air supply unit 16 and the member 1 to be coated from the suction port of the suction unit 7. Measurement for setting the rate of the airflow was conducted as follows.

While the member 1 to be coated was held with the chuck 2 and air was suctioned by the suction unit 7, smoke was introduced from the opening at the upper end of the cylindrical member 6*a* using a smoke flow marker, and the time taken for the smoke to travel from the upper end of the tubular member 6*a* to the lower end of the tubular 6*c* was measured. The amount of suction was adjusted by an air volume controlling valve installed at the end of the suction pipe 8.

EXAMPLE 4

Coating Samples α and Coating Samples β were fabricated as in Example 3 except that intermediate layer-forming coating solution 2 was applied by dip-coating to form the intermediate layer. The results are shown in Table 1.

EXAMPLE 5

Coating Samples α and Coating Samples β were fabricated as in Example 3 except that the dimensions of respective parts of the telescopic sliding hood 6 were set as shown in Table 1 in applying the intermediate layer-forming coating solution and the charge generation layer-forming coating solution by dip-coating. The results are shown in Table 1.

EXAMPLE 6

Coating Samples α and Coating Samples β were fabricated as in Example 5 except that intermediate layer-forming coating solution 2 was applied by dip-coating to form the intermediate layer. The results are shown in Table 1.

EXAMPLE 7

Coating Samples α and Coating Samples β were fabricated as in Example 3 except that the dimensions of respective parts of the telescopic sliding hood 6 were set as shown in Table 1 in applying the intermediate layer-forming coating solution and the charge generation layer-forming coating solution by dip-coating. The results are shown in Table 1.

EXAMPLE 8

Coating Samples α and Coating Samples β were fabricated as in Example 7 except that intermediate layer-forming coating solution 2 was used in forming the intermediate layer. The results are shown in Table 1.

TABLE 1

| | Inner diameter of tubular member (mm) | | | Step height t (mm) | | Level of shade variation in Coating Samples α (Number of samples) | | | | Level of shade variation in Coating Samples β (Number of samples) | | | |
|---|---|---|---|---|---|---|---|---|---|---|---|---|---|
| | 6a | 6b | 6c | 6a/6b | 6b/6c | A | B | C | D | A | B | C | D |
| Ex. 1 | 41 | 47 | 53 | 3 | 3 | 16 | 3 | 1 | 0 | 13 | 2 | 1 | 0 |
| Ex. 2 | 41 | 47 | 53 | 3 | 3 | 14 | 4 | 2 | 0 | 10 | 3 | 1 | 0 |
| Ex. 3 | 41 | 47 | 53 | 3 | 3 | 17 | 2 | 1 | 0 | 15 | 2 | 0 | 0 |
| Ex. 4 | 41 | 47 | 53 | 3 | 3 | 16 | 3 | 1 | 0 | 13 | 2 | 1 | 0 |
| Ex. 5 | 44 | 50 | 56 | 3 | 3 | 18 | 2 | 0 | 0 | 16 | 2 | 0 | 0 |
| Ex. 6 | 44 | 50 | 56 | 3 | 3 | 17 | 3 | 0 | 0 | 16 | 1 | 0 | 0 |
| Ex. 7 | 46 | 50 | 54 | 2 | 2 | 20 | 0 | 0 | 0 | 20 | 0 | 0 | 0 |
| Ex. 8 | 46 | 50 | 54 | 2 | 2 | 19 | 1 | 0 | 0 | 19 | 0 | 0 | 0 |
| Co. Ex. 1 | 41 | 47 | 53 | 3 | 3 | 3 | 5 | 8 | 4 | 0 | 0 | 2 | 1 |
| Co. Ex. 2 | 41 | 47 | 53 | 3 | 3 | 7 | 5 | 5 | 3 | 3 | 1 | 2 | 1 |
| Co. Ex. 3 | 41 | 47 | 53 | 3 | 3 | 11 | 5 | 2 | 2 | 6 | 2 | 1 | 2 |
| Co. Ex. 4 | 41 | 47 | 53 | 3 | 3 | 6 | 5 | 5 | 4 | 3 | 0 | 1 | 2 |

Ex.: Example,
Co. Ex.: Comparative Example

TABLE 2

| | Image evaluation results | | |
|---|---|---|---|
| | No unevenness | Slight unevenness | Substantial unevenness |
| Example 1 | 20 | 0 | 0 |
| Example 2 | 19 | 1 | 0 |
| Comparative Example 1 | 0 | 4 | 16 |
| Comparative Example 2 | 2 | 14 | 4 |
| Comparative Example 3 | 13 | 4 | 3 |
| Comparative Example 4 | 7 | 6 | 7 |

(Number of samples)

[Results of Visual Evaluation]

When Examples 1 and 3 and Examples 2 and 4 are respectively compared, Examples 3 and 4 exhibit less shade variation. As for the incidence of the shade variation near the upper part in the dip-coating direction, Examples 1 and 2 showed a higher incidence than Examples 3 and 4.

When Examples 3 and 5 are Examples 4 and 6 are respectively compared, Examples 5 and 6 exhibit less shade variation. As for the incidence of the shade variation near the connecting portion between the tubular member 6*a* and the tubular member 6*b*, Examples 3 and 4 exhibited a higher incidence than Examples 5 and 6.

When Examples 5 and 7 and Examples 6 and 8 are respectively compared, Examples 7 and 8 exhibit less shade variation. As for the incidence of the shade variation near the connecting portion between the tubular member 6*a* and the tubular member 6*b*, Examples 5 and 7 exhibited a higher incidence than Examples 6 and 8.

Coating Samples α, Coating Samples β, and the electrophotographic photosensitive members prepared in Comparative Example 1 exhibited large shade variation overall. In Coating Samples α, roughness was observed in the film surface near the upper portion in the dip-coating direction. This is presumably attributable to occurrence of condensation during evaporation of the solvent in the coating film (coating solution) adhering on the surface of the cylindrical supporting member.

Coating Samples α, Coating Samples β, and the electrophotographic photosensitive members prepared in Comparative Example 2 exhibited large shade variation near the upper part in the dip-coating direction. Also, shade variation was frequently observed near the connecting portion between the tubular member 6*a* and the tubular member 6*b* and the connecting portion between the tubular member 6*b* and the tubular member 6*c*.

In Coating Samples α, Coating Samples β, and the electrophotographic photosensitive members prepared in Comparative Example 3, shade variation was frequently observed near the lower part in the dip-coating direction.

In Coating Samples α, Coating Samples β, and the electrophotographic photosensitive members prepared in Comparative Example 4, shade variation was frequently observed near the lower part in the dip-coating direction. Also, shade variation was frequently observed near the connecting portion between the tubular member 6*a* and the tubular member 6*b* and the connecting portion between the tubular member 6*b* and the tubular member 6*c*.

[Image Evaluation Results]

When images formed by using the electrophotographic photosensitive members prepared in Example 1 and 2 were evaluated, substantially no unevenness was observed in all samples. In contrast, some of the images formed by using the electrophotographic photosensitive members prepared in Comparative Examples had variation that corresponded to the visual evaluation, and the positions of the unevenness observed substantially coincided with the positions where the shade variation was identified with visual observation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-266532, filed Oct. 15, 2008, which is hereby incorporated by reference herein in its entirety.

The invention claimed is:

1. A dip-coating process comprising:

immersing a member to be coated in a coating solution in a coating vessel; and lifting the member to be coated while covering a side surface of the member to be coated with a telescopic sliding hood to form a coating film on a surface of the member to be coated, wherein the telescopic sliding hood includes a plurality of tubular members connected so that their diameters successively decrease upward in a dip-coating direction, and can cover the side surface of the member to be coated by extending in association with the movement of the member to be coated during the lift of the member to be coated, while the member to be coated is being lifted, a downward airflow in the dip-coating direction is generated in a gap between an inner surface of the telescopic sliding hood and the member to be coated to discharge solvent vapor to outside the telescopic sliding hood, and the downward airflow in the dip-coating direction is generated by suctioning, from a suction port provided near a lower end of the telescopic sliding hood, an atmosphere in the gap, wherein, in every connecting portion between one tubular member of the telescopic sliding hood and an adjacent tubular member at the upper side in the dip-coating direction, the tubular member has a first ring member smaller in diameter than the tubular member at an upper end of the tubular member, the adjacent tubular member has a second ring larger in diameter than the adjacent tubular member at an lower end of the adjacent tubular member, the tubular member and the adjacent tubular member are connected to each other by hooking the first ring and the second ring with each other, the second ring member extends farther downward than the adjacent tubular member in a dip-coating direction, and a lower end of the second ring is tapered toward outside of the adjacent tubular member.

2. The dip-coating process according to claim 1, wherein, in every connecting portion between one tubular member of the telescopic sliding hood and an adjacent tubular member at the upper side in the dip-coating direction, a step height t (mm) between inner surfaces of the one tubular member and the adjacent tubular member and a distance d (mm) between the inner surface of the one tubular member and the surface of the member to be coated satisfy the relationship below:

$$t \leq d \times 0.3.$$

3. A method for making an electrophotographic photosensitive member, comprising a step of forming a coating film on a surface of a member to be coated by dip-coating, wherein the dip-coating includes the dip-coating process according to claim 1.

* * * * *